United States Patent [19]

Cobbs, Jr. et al.

[11] Patent Number: 4,515,836

[45] Date of Patent: May 7, 1985

[54] PROCESS FOR COATING SUBSTRATES WITH AQUEOUS POLYMER DISPERSIONS

[75] Inventors: Walter H. Cobbs, Jr., Amherst; William R. Rehman, Vermillion, both of Ohio

[73] Assignee: Nordson Corporation, Amherst, Ohio

[21] Appl. No.: 500,877

[22] Filed: Jun. 3, 1983

Related U.S. Application Data

[63] Continuation-in-part of Ser. No. 399,047, Jul. 16, 1982, abandoned.

[51] Int. Cl.[3] ..... B05D 1/02

[52] U.S. Cl. ..... 427/425; 427/421; 428/35; 428/483; 215/1 C

[58] Field of Search ..... 427/421, 425; 428/35, 428/483; 215/1 C

[56] References Cited

U.S. PATENT DOCUMENTS

| | | |
|---|---|---|
| 2,763,575 | 9/1956 | Bede . |
| 3,696,987 | 10/1972 | Schuff et al. . |
| 3,804,663 | 4/1974 | Clark . |
| 3,932,104 | 1/1976 | Schnedier . |
| 3,943,219 | 3/1976 | Aoki . |
| 3,947,176 | 3/1976 | Rainville . |
| 3,998,577 | 12/1976 | Farrell . |
| 4,004,049 | 1/1977 | Horwat et al. . |
| 4,098,932 | 7/1978 | Frische . |
| 4,127,633 | 11/1978 | Addleman . |
| 4,230,068 | 10/1980 | Itoh et al. . |
| 4,300,966 | 11/1981 | Hoffmann . |
| 4,317,793 | 3/1982 | Hubert et al. . |
| 4,319,701 | 3/1972 | Cambio . |
| 4,321,029 | 3/1982 | Aoki . |
| 4,323,341 | 4/1982 | Valyi . |
| 4,323,411 | 4/1982 | Uhlig . |
| 4,370,368 | 1/1983 | Hirata et al. . |
| 4,393,106 | 7/1983 | Maruhashi ..... 427/412.4 |

FOREIGN PATENT DOCUMENTS 2014160 8/1979 United Kingdom .

OTHER PUBLICATIONS

Phillip L. DeLassus, Donald L. Clarke and Ted Cosse, "Saran Coatings on PET Bottles: Application, Performance and Recycle", Revised 3/2/82, (13 pp. article including cover p.)

*Primary Examiner*—Shrive P. Beck

*Attorney, Agent, or Firm*—Wood, Herron & Evans

[57] ABSTRACT

A process for providing a substrate such as a polyethylene terephthalate container with a gas barrier coating of a copolymer of vinylidene chloride is disclosed. The process includes locating the container to be coated in close proximity to one or more airless spray nozzles and impacting the outside surface of the container with a stream of a stabilized aqueous polymer dispersion such as an aqueous polyvinylidene chloride dispersion. The impacting force of the stable polyvinylidene chloride dispersion on the surface of the container is sufficient to cause selective destabilization of the dispersion at the surface interface to form a gel layer containing the polymer in the continuous phase. This gel layer serves as an adhesive layer for an overlying layer of the aqueous polymer dispersion as a continuous uniform coating. The resulting wet coating does not sag or run off. The coating on the container is then dried in a controlled atmosphere to complete the gel formation throughout its thickness whereupon it is further dried to remove the water from the coating and to collapse the gel to form a film without distoring the container. The dried coating is smooth, uniform and uniformly transparent. In operation, the overspray can be collected and returned to achieve greater than 95% material efficiency. The process can be carried out in a continuous manner to provide a continuously moving series of containers with a uniformly transparent, gas barrier polyvinylidene chloride coating at production rates suitable for commercial applications.

28 Claims, 5 Drawing Figures

DRYING PROCESS FOR IMPACT GEL/EMULSION
—TWO LAYER WET COATING

PROCESS FOR COATING SUBSTRATES WITH AQUEOUS POLYMER DISPERSIONS

RELATED APPLICATION

This application is a continuation-in-part of U.S. patent application Ser. No. 399,047 of Walter H. Cobbs Jr. et al filed July 16, 1982, now abandoned, directed to PROCESS FOR BARRIER COATING POLYETHYLENE TEREPHTHALATE CONTAINERS WITH A COPOLYMER OF VINYLIDENE CHLORIDE.

BACKGROUND OF THE INVENTION

1. Field of the Invention

This invention relates to coating substrates, especially preformed plastic substrates, and barrier coating of plastic containers. For instance, polyethylene terephthalate bottles are coated with a copolymer of polyvinylidene chloride to provide the bottles with a gas barrier coating. More particularly, conventional airless spray equipment is employed to provide the surface of polyethylene terephthalate containers with a high quality, uniformly transparent barrier coating to substantially reduce or prevent the passage of gases through the walls of the containers.

2. Description of the Art

Plastic containers for beverages made of polyethylene terephthalate (commonly referred to as PET bottles or containers) have become popular for a number of reasons including their light weight; their strength and capacity to hold beverages, including carbonated beverages such as soft drinks and colas; their lack of toxicity and the economies of materials and methods by which the containers can be manufactured. Typically, these containers are made by a process called "blow molding" in which a preform or parison is heated and stretched both axially and radially by air pressure in a mold to the desired shape of the container. Such biaxially oriented PET containers are strong and have good resistance to creep, i.e., they maintain their dimensions even under the internal pressure caused by gases in the liquid inside the bottles. Moreover, the containers are relatively thin walled, and hence are lightweight but, nevertheless, are capable of withstanding without undue distortion over the desired shelf life of the product the internal pressure exerted by a carbonated liquid, such as soft drinks and colas.

However, a major problem with such thin-walled PET containers are that they are permeable to gases such as carbon dioxide and oxygen. That is, with PET containers, these gases are capable of migrating or passing through the wall of the container due to the pressure differential between the gas inside and the pressure outside of the container. Thus, in the case of bottles containing carbonated liquids the pressurizing carbon dioxide in the liquid which is typically at a pressure on the order of 60–75 pounds per square inch gauge (psig) can migrate through the walls of the container and be released. This migration of carbon dioxide takes place over a period of time. As a result, the carbonated liquid gradually loses its carbon dioxide; and, when the bottle is opened, the beverage lacks carbonation or is what is commonly referred to as being "flat". Conversely, PET containers are permeable to oxygen which permits the oxygen in room air to migrate through the walls and into the container which can cause spoilage of certain comestibles contained in the containers which are subject to deterioration by the presence of oxygen. This then affects the flavor and quality of the container contents.

At present, one commercial manufacturer and bottler of carbonated soft drinks requires that the loss of pressure in PET bottles at room temperature (23° C. 50% r.h.) over a sixteen week period be no more than 15%, e.g., no more than 9 psig starting from 60 psig. This is referred to as the "shelf life" of the bottle, i.e., how long the bottle and its contents can be held prior to sale without unacceptable deterioration of product quality. With uncoated PET bottles, in some cases, the time required to distribute the bottles to the point of sale alone can exceed this shelf life for up to one-half of the United States.

The problem of gas permeability in PET bottles or containers is particularly severe where the container is relatively small; and, as a result, the ratio of the surface area of the container to the volume of the contents is larger than with larger containers. An example of such a container is a ½ liter size container, which is a desirable size for carbonated liquids such as soft drinks and colas.

For the foregoing reasons, prior workers in the art have found it desirable to provide PET containers with a layer of material which has a low vapor and gas permeability which thus provides a coating or barrier on the surface of the containers to prevent the passage of gases therethrough. One material which has been employed by prior art workers to provide such a barrier coating is a copolymer of vinylidene chloride (commonly referred to as PVDC). This material is a polymer which may be applied as a latex, i.e., an aqueous polymer dispersion and thereafter dried to form the desired barrier coating. Various techniques have been employed to apply barrier coatings of PVDC latices including the coating of PET preforms prior to blow molding and roll coating of the surface of blow molded PET containers.

Although PVDC has been successfully applied to the surface of PET containers by such methods as roller coating, such a process is not particularly efficient or economical in that it does not lend itself to high speed production rates. That is, in industry, PET bottles are produced at a rate of 700 to 1800 bottles per minute. Thus, an efficient and economic coating process should provide the PET bottle with a PVDC coating at a rate of 300 bottles per minute or greater. Currently, the cost of equipment to satisfy this production rate or even higher rates by roller coating is inordinately high.

Prior patents disclose a number of techniques for coating polymer latices including roller coating, brush coating, dip coating, spray coating, electrostatic coating, centrifugal coating, cast coating, and others. For example, recently issued U.S. Pat. No. 4,370,368 refers to such techniques in general and, in the operating examples, again generally refers to them as suitable ways to deposit the latex on a preformed plastic surface usually with a wetting property-improving preliminary treatment such as anchoring layers or the like. Specific reference is made in this patent to "spray coating" of latex in the examples, but for instance, in Examples 10 and 13, the plastic bottle is first dip-coated to provide an anchoring agent before spray-coating with a PVDC latex. Other patents have dealt with the problems of attempting to spray coat plastic bottles with latices such as U.S. Pat. Nos. 3,696,987; 3,804,663; 4,004,049 and British Patent No. 2,014,160. There may be other patents of interest as background to this invention, but the above are merely cited not to completely develop the prior art but to help illustrate and highlight this invention. For instance, U.S. Pat. No. 3,804,663 approaches the known problems of latex coating by spinning the coating during spraying thereby causing centrifugal force to distribute and/or hold the dispersion uniformly on the wall and heating to fusion while continuing to spin. U.S. Pat. No. 4,004,049 deals with sprayable latex adhesives with the objective to break the emulsion upon spraying, i.e., atomize and destabilize the latex to produce a pebbly, particulate pattern which requires little or no drying. While the aforementioned remaining patents again generally mention spraying, no attention is apparently given to problems associated with such techniques.

It is known in industry that spray coating is an efficient and high speed method of applying coating materials in a liquid form to substrates. However, as evidenced by the above patents, special considerations apply when attempting to spray polymer latices. It would be highly desirable if a process could be provided for using conventional equipment to coat such latices on plastic bottles such as PET. But, applicants have found that when PET bottles are spray coated with aqueous polymer dispersions of PVDC according to conventional spray coating techniques the resulting coating is very non-uniform and, when dried, the coating is not uniformly transparent such that it distorts the surface appearance of the bottle and thus is totally commercially unacceptable. Moreover, the pressure losses from such spray coating containers are unacceptably high. That is, in today's commercial applications, the PVDC or any polymer barrier coating on PET containers must be highly uniform, smooth, clear, uniformly transparent, glossy, not subject to delamination, and not cracked or crazed as well as substantially impermeable to gas migration. Otherwise, the coated container is simply unusable commercially. Prior to the present invention, a process has not been available to coat with conventional spray equipment and processing PET containers with PVDC which produces barrier coatings meeting these requirements.

SUMMARY OF THE INVENTION

In one broad aspect of this invention, a unique method of coating aqueous polymer latices or dispersions onto substrates, especially plastic substrates, is provided. The method is achieved by impacting a stream of an aqueous polymer dispersion onto the substrate surface so as to destabilize and invert the dispersion at the surface to form a gel layer having the polymer in the continuous phase of the layer. Overlying the gel layer is a layer of the polymer dispersion. Thus, the process provides initially a wet uniform coating of the substrate with a gel layer that adheres the dispersion to the substrate and this physicochemical state of the coating is achieved by impacting a stream of the aqueous polymer dispersion onto the substrate. The uniform coating is then dried to complete the gellation of the entire coating thickness prior to complete coalescence into a polymer film.

Advantageously, it has been found that conventional airless spray equipment may be used to achieve the results. However, the results are achieved in a very unconventional manner in that the equipment is used to create the stream of polymer latex so as not to destabilize it until it impacts on the substrate surface and then only to produce a wet coating of the dispersion having the underlying gel layer. Applicants have discovered that this critical process leads to barrier coatings which exceed known properties heretofore achieved by the industry.

The present invention has also overcome the problem of applying PVDC barrier coatings on PET containers by providing a coating process which results in PET containers having a substantially gas-impermeable, clear, smooth, uniformly transparent PVDC barrier coating having a high gloss which does not contain cracks or crazing. Preferably, this process is carried out by airless spraying equipment for coating PET containers with an aqueous dispersion of PVDC and thus is amenable to high speed production processes with high coating efficiencies.

According to the process of the present invention, a PET container at room temperature is located in close proximity to one or more airless spray nozzles through which is passed an aqueous dispersion of PVDC such that the outside surface of the container is impacted with a stream of the aqueous dispersion of PVDC to provide the outside surface of the container with a wet coating of PVDC having the gel interfacial layer and the overlying aqueous dispersion uniformly deposited as an integral coating. The preferred bottle-coating process proceeds by first completely depositing the gel layer on the entire surface of the bottle. At this point, the gel layer serves as a buffer or cushion to the further development of gel because the impact force is reduced and the gel serves as a wetting surface for the overlying layer of polymer dispersion. The coating is then dried to remove the water and complete the gel formation from the interfacial layer foundation at the PET surface to the outermost surface of the PVDC coating. Thereafter, heating is continued to film-form or completely coalesce the PVDC polymer coating. It is preferred to quickly warm the wet coating with radiant heat to first complete the gel formation of the coating which has been initiated by impacting the dispersion. The oven time and temperature are short enough to prevent distortion of the PET bottle. Thereafter, drying is continued preferably with radiant heat to remove the water and completely collapse or coalesce the gel into a coating film. In order to provide the superior barrier coating properties of PVDC on PET, these steps are essential.

Another method for drying of the coating is carried out at a controlled humidity and temperature to prevent too rapid a removal of water from the coating. For instance a preferred environment for drying of the coating is 20 to 90% relative humidity and a temperature of 170°–175° F. Again the oven time is short enough to keep the temperature of the PET container below about its 140° F. distortion temperature but yet long enough to dry the coating to a substantially tack-free condition. The resulting coating is highly uniform, smooth, clear, uniformly transparent, glossy, not subject to delamination, and is not cracked or crazed. Moreover, the coating is substantially gas-impermeable and meets the "shelf life" standard of no more than a 15% loss of pressure over a sixteen week period referred to above.

In the practice of this invention, a stream of a stablized dispersion of polymeric particles in water impacts upon the surface and destabilization of the dispersion occurs at the surface of the container. Destabilization of the dispersion at the container surface upon impact causes an inversion of the dispersion into thin gel layer at the interface with the surface. This gel layer now contains the polymer in the continuous phase and the water in the discontinuous phase. The thin gel layer serves as the foundation for the uniform deposition of the polymeric dispersion onto the surface without run-off, sagging or discontinuity. The aqueous polymeric dispersion is then capable of being adhered to the surface of the container by means of the viscous gel layer with which it is intimately associated and upon which the uninverted aqueous dispersion of polymeric particles is layered. While the thicknesses of these layers will vary, for instance in a total wet coating thickness of about 4 to 24 microns, the gel layer may be 2 to 12 microns, more or less, and the layer of uninverted dispersion makes up the difference in coating thickness. It is believed that between the gel layer and the overlying aqueous dispersion there is a gradual interchange of materials. Applicants do not wish to be limited to the precise inter-physical relationship of these layers. However, it has been found critical to impact the surface with a stream of the dispersion so that selective destabilization of the dispersion takes place at the surface to form the essential gel layer. It has been found that the gel layer serves several important functions which distinguish this process from the prior art processes. It enables aqueous polymeric dispersions to be uniformly wet coated onto substrates with sufficient adhesion in a rapid and efficient manner with conventional spraying equipment. The gel layer at the interface of the surface enables, upon drying of the coating, a continuous inversion of the dispersion to a complete gel layer which may then be completely coalesced to a uniform film of polymer having superior adhesive and barrier properties.

It has been demonstrated that the critical gel layer is achieved by the close proximity of the surface of the bottle to the airless spray nozzle in combination with the pressure of the liquid stream to cause a sufficiently high impact force of the PVDC coating latex with the surface of the container. Furthermore, it has been demonstrated that complete atomization or spraying in the classical or industrial sense will not achieve the results of this invention. It has been found when atomization is complete at a distance which is essential for spray coating by employing airless spray nozzles, for instance, then such an atomization is completely unsatisfactory for purposes of this invention. Under such circumstances, the atomized particle reaches the substrate with insufficient energy to impact and form a gel layer. Instead, such atomized particles collect on the surface and create a pebbly or non-uniform coating and when dried the barrier properties are poor. Other attempts to coat dispersions without impacting may result in non-uniformity of the dispersions on the surface, without adequate wetting and even run off because of low viscosities. All of these negative results are overcome by impacting a stream of the dispersion on the surface of the substrate. When achieving the desired results, the stream of latex from the airless spray nozzle is just on the verge of breaking-up or has broken-up into fibrils or filaments, or even droplets which have not fully contracted to their atomized state, such that the stream reaches the substrate surface with a force to cause phase inversion on the surface, not before. Thus, "stream" of aqueous polymer dispersion as it is used herein means continuous liquid, broken filaments or fibrils, or even droplets, providing that the force with which the stream impacts the surface is sufficient to invert the dispersion into a gel layer which serves as the interfacial layer as developed above. If phase inversion is achieved upon leaving the nozzle before reaching the surface, then the coating will be pebbly or mottled and uniform coalescence of the wet coating will be lost along with good barrier properties of the dried coating. Correspondingly, if phase inversion does not occur at all upon spraying, then poor results are similarly achieved. In contradistinction, when the force is sufficient to impact the stream of stabilized dispersion of polymer for selective destabilization at the surface, then the beneficial results of this invention are achieved, i.e., the gel layer forms which serves as the interfacial layer between the substrate and the overlying polymer dispersion. From such a coating structure it has been found there results excellent wet adhesion of a superior coating which in turn may be dried and coalesced into a continuous film which is bound to the substrate.

The practice of the present invention thus provides a clear, uniformly transparent PVDC barrier coating on PET containers. The PVDC coating material is applied to a thickness sufficient to meet the requirement that the loss of pressure from the container be less than or equal to 9 psig beginning from 60 psig over 16 weeks or more with the containers being held at 23° C. (73° F.), 50% r.h. It has been reported in a paper authored by Phillip T. DeLassus, Donald L. Clarke and Ted Cosse of the Dow Chemical Co. of Midland, Mich. entitled "Saran Coatings on PET Bottles: Application, Permanance and Recycle" that a PVDC coating having a thickness in the range of about 0.1 to 0.2 mils (about 2½ to 5 microns) is sufficient to meet such a specification. A presently preferred range of coating thicknesses is about 2½ to 12 microns and preferably about 8 to 9 microns.

In operation, the present invention is amenable to the coating of containers either in a batch process or in a continuous process where a line of continuously moving containers are coated and dried. Moreover, alternative means can be provided for exposing the outside surface of the containers to be coated to the airless spray stream of PVDC coating material. One means is to rotate the container in front of one or more airless spray nozzles to achieve complete coating of the outside surface to be coated. Another method is to have a number of nozzles oriented such that the total outside surface area of the container to be coated is impacted by the material without rotation of the container.

Among the many advantages of the present invention is that it admits of a highly efficient and relative high production rate process for applying PVDC coatings to PET bottles such as by moving a line of PET containers through a continuous coater at coating rates of 300 bottles per minute or greater. This operation is carried out inside of an enclosure where overspray is collected and returned to be repumped to the spray nozzles with 95+% transfer efficiency. The resulting coatings are substantially gas impermeable, clear, smooth, uniformly transparent, and do not contain any cracking or crazing and are not subject to delamination. All in all, the present invention provides a process for coating plastic substrates, especially PET bottles with PVDC barrier coatings to provide coatings having superior physical properties, which process can be carried out at production rates suitable for commercial applications.

Other objects and advantages of the present invention will become apparent from the following detailed description, reference being had to the accompanying drawing.

DETAILED DESCRIPTION OF THE INVENTION

Figure 1:
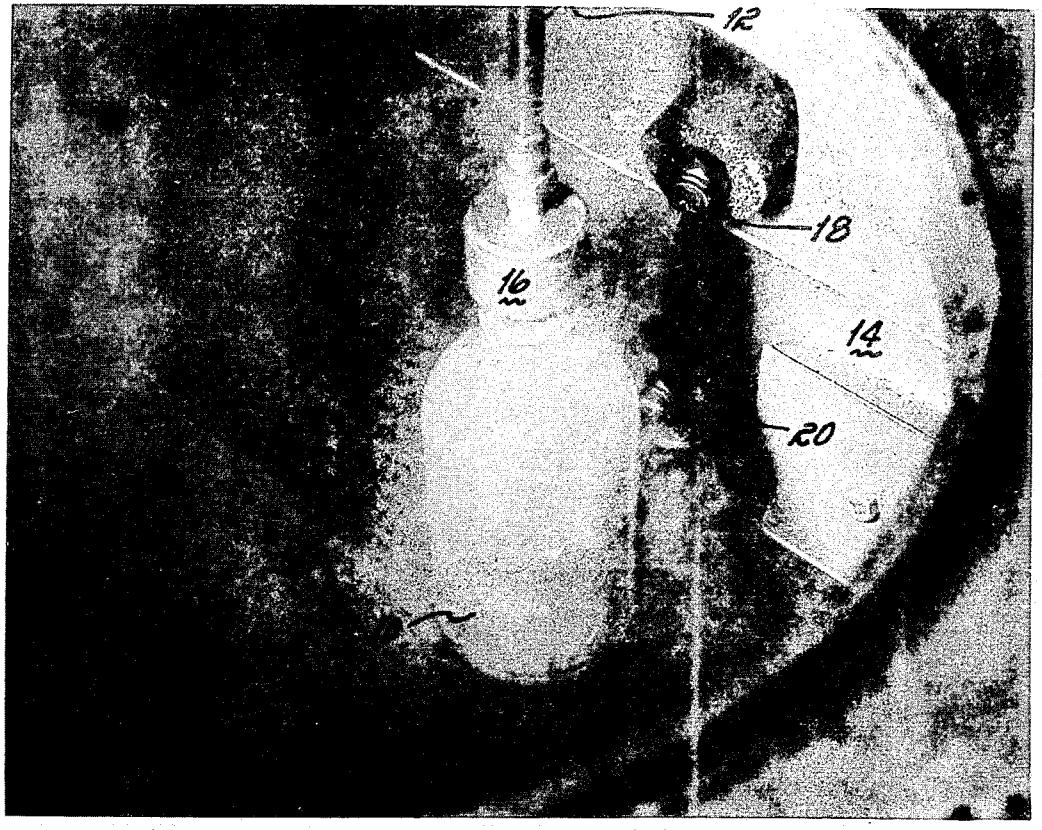
FIG. 1 is a photograph of an experimental apparatus showing the coating of a PET bottle according to the present invention.

In one of its general aspects, the process contemplates using airless spray nozzles for coating of PET containers or bottles at room temperatures with aqueous dispersions of a polyvinylidene chloride copolymer. As used herein, the term "dispersion" encompasses an emulsion, solution or latex and denotes a fine dispersion of a polymer, e.g., on the order of 1000 to 2000 Angstroms in size, dispersed in a continuous phase consisting essentially of water. Typically, the percentage of polymer solids in the dispersion is on the order of 40 to 60% solids by weight. Examples of such a copolymer emulsion suitable for use in the present invention are DARAN 820 sold by W. R. Grace & Company, Chemical Division, Baltimore, Md.; Dow XD30563.2 sold by Dow Chemical Company, Midland, Mich.; Morton Serfene 2011 sold by Morton Chemical Company, Crystal Lake, Ill.; and Union P-931, sold by Union Chemical Division of the Union Oil Company, Anaheim, Calif. Each of these latices are copolymers of vinylidene chloride in a substantial amount with minor amounts of the comonomers lower alkyl (methyl or ethyl) acrylate and acrylonitrile. These polymers typically include 99 to 70% by weight, preferably 69 to 75% by weight, of vinylidene chloride and 1 to 30% by weight, preferably 4 to 25% by weight of at least one acrylic or methacrylic monomer, and as an optional component, other ethylenically unsaturated monomer in an amount of up to 100 parts by weight, preferably 50 parts by weight, per 100 parts by weight of the total amount of said vinylidene and acrylic monomers. Examples of these last mentioned polymers include: vinylidene chloride/acrylonitrile copolymer, vinylidene chloride/acrylonitrile/methacrylonitrile copolymer, vinylidene chloride/methacrylonitrile copolymer, vinylidene chloride/acrylonitrile/glycidyl acrylate copolymer, vinylidene chloride/acrylonitrile/glydicyl methacrylate copolymer, vinylidene chloride/acrylonitrile/acrylic monoglyceride copolymer, vinylidene chloride/ethyl acrylate/glycidyl acrylate copolymer, vinylidene chloride/methyl methacrylate/styrene copolymer, vinylidene chloride/acrylonitrile/styrene copolymer, vinylidene chloride/ acrylonitrile/trichloroethylene copolymer, vinylidene chloride/acrylonitrile/vinyl chloride copolymer, vinylidene chloride/acrylonitrile/methacrylic monoglyceride/trichloroethylene copolymer, and vinylidene chloride/methoxyethyl acrylate/methyl acrylate/trichloroethylene copolymer. As other examples of coating polymer latices or dispersions, there may be mentioned latices based on styrene/butadiene or styrene/alkyl acrylate copolymers which have a high styrene content and preferably comprise more than 60% of styrene units; alkyl or aryl esters of unsaturated carboxylic acids, such as acrylates and methacrylates; unsaturated nitriles such as acrylonitrile and methacrylonitrile; vinyl halides, such as vinyl chloride and vinyl bromide, and on vinylidene chloride; vinyl acetate. Polyvinylidene chloride latices are of particular value because they contribute significantly to the impermeability and have a good adhesion and a good appearance. The proportion of vinylidene chloride in the copolymers is preferably greater than about 70% and the other monomers can be, for example, vinyl chloride, acrylates or methacrylates, or unsaturated organic acids such as acrylic, methacrylic, itaconic and fumaric acids.

The plastics used as a support or substrate for the coating compositions comprise, for example, polyolefins such as high and low density polyethylene and polypropylene, polystyrene and styrene/acrylonitrile copolymers, polyvinyl chloride, vinyl chloride copolymers, polycarbonates, polyacetals, polyamides and polyesters such as poly(glycol terephthalates). Optional plastic bottles formed from a melt-moldable thermoplastic resin by injection molding, blow molding, biaxially drawing blow molding or draw forming can be used as the plastic bottle substrate, for example, low density polyethylene, medium density polyethylene, high density polyethylene, polypropylene, olefin type copolymers such as ethylene/propylene copolymers, ethylene/butene copolymers, ionomers, ethylene/vinyl acetate copolymers and ethylene/vinyl alcohol copolymers, polyesters such as polyethylene terephthalate, (PET), polybutylene terephthalate and polyethylene terephthalate/isophthalate, polyamides such as nylon 6, nylon 6,6 and nylon 6,10, polystyrene, styrene type copolymers such as styrene/butadiene block copolymers, styrene/acrylonitrile copolymers, styrene/butadiene/acrylonitrile copolymers (ABS resins), polyvinyl chloride, vinyl chloride type copolymers such as vinyl chloride/vinyl acetate copolymers, polymethyl methacrylate and acrylic copolymers such as methyl methacrylate/ethyl acrylate copolymers, and polycarbonate.

Some material compositions may have a surface tension such that wetting of the substrate is difficult. In such instances, pretreatment by methods known by those skilled in the art including flame treatment and corona discharge will enhance wetting. The coating is applied to the exterior of the PET containers by positioning the containers in close proximity to one or more airless spray nozzles and impacting the surface of the containers with a stream of the dispersion ejected from the airless spray nozzles. It is desirable to maintain the relative humidity in the area of the container being coated at greater than 90%. This may be accomplished, for example, by spraying the walls of the coating chamber with water or by injecting steam into the coating area through one or more nozzles. In continuous coaters where the overspray is collected and repumped to the nozzles, additional water would dilute the coating material. Thus, it is desirable to spray the emulsion itself against walls of the chamber or into the coating area in addition to impact spraying the bottles during the coating operation to maintain the desired relative humidity in the enclosure without dilution of the PVDC coating material. Nozzle plugging is also minimized by maintaining the desired relative humidity in the coating enclosure. Maintaining the relative humidity above 90% keeps the coating from drying too quickly in the coating enclosure and thus minimizes the formation of microcracks in the coating. Microcracks provide avenues for the migration of gases through the coating and can cause non-transparency of the coating. Microcracks thus are to be avoided.

During the coating operation the bottles may be rotated, e.g., at speeds of 500 rpm, up to 1500 rpm, to insure complete coverage of the outside surface of the bottles with the liquid coating material being impact sprayed from one or more fixed spray nozzles. Also, the nozzles could be mounted on movable arms such that they could be moved to cover the surface of a series of non-rotating bottles. Still, further, a number of fixed nozzles pointed in different directions could be used again to achieve complete exposure of the bottle surface to be coated to the liquid stream or impact spray.

Whatever the apparatus employed, it is critical to achieving high quality, uniformly transparent PVDC coatings on PET bottles that the PVDC stream or impact spray contact the bottle with a force sufficient to initiate uniform coalescence of the polymer, i.e., to form the gel layer and to form a uniform coating having the desired properties recited above. In an airless spray application system, it has been found that the impacting force of the liquid spray or stream on the bottle surface is a function of the hydraulic pressure, nozzle size, rotational speed of the bottle, if any, and the spacing distance of the bottle surface to be coated from the nozzle surface. All other variables being equal, it has been found that by locating the bottles physically in close proximity to the nozzles that excellent results can be achieved.

This discovery is demonstrated by and can be further appreciated from the following examples.

EXAMPLE I

Referring to FIG. 1, a ½ liter bottle 10 was mounted vertically on a spindle 12 which extended into a spray coating chamber 14. The bottle 10 was held at its open end by threading the cap end of the bottle 10 into an end cap 16 mounted on the end of the spindle 12. Two airless spray nozzles 18 and 20 were mounted in the wall of the spray coating chamber 14. These nozzles were two 6/12 nozzles, Part No. 710244 manufactured by Nordson Corporation of Amherst, Ohio. These nozzles operate at 0.06 gallons per minute (as measured with a water flow rate of 500 psig) and produce a 12-inch wide fan 10 inches away from the nozzles. The nozzles were operated without restrictors. The upper nozzle 18 was pointed 10° below the horizontal and the lower nozzle 20 was pointed 8° above the horizontal such that the nozzle openings were spaced vertically one from another about 4½ ". This arrangement produced a stream of dispersion substantially perpendicular to the bottle surface and a strip of coating application area about 1 inch wide from top to bottom of the bottles, which were about 7 inches in height, with an overlap of about 1 inch at the middle of the bottle. The bottles 10 were rotated at 500 rpm by rotating the spindle 12, and the nozzles 18 and 20 were actuated 200 milliseconds for application of the spray coating material.

To demonstrate the effect of locating the bottles in close proximity to the nozzles, a series of tests were run with bottles spaced various distances from the nozzles. FIG. 1 shows the bottle being impact sprayed with a stream of emulsion. The bottle is located at a distance of 2½ inches from the nozzles, which is within the practice of the present invention, using W. R. Grace No. 820 PVDC emulsion identified above, a pressure of 650 psig, 200 millisecond exposure, and 500 rpm rotation speed.

Figure 2:
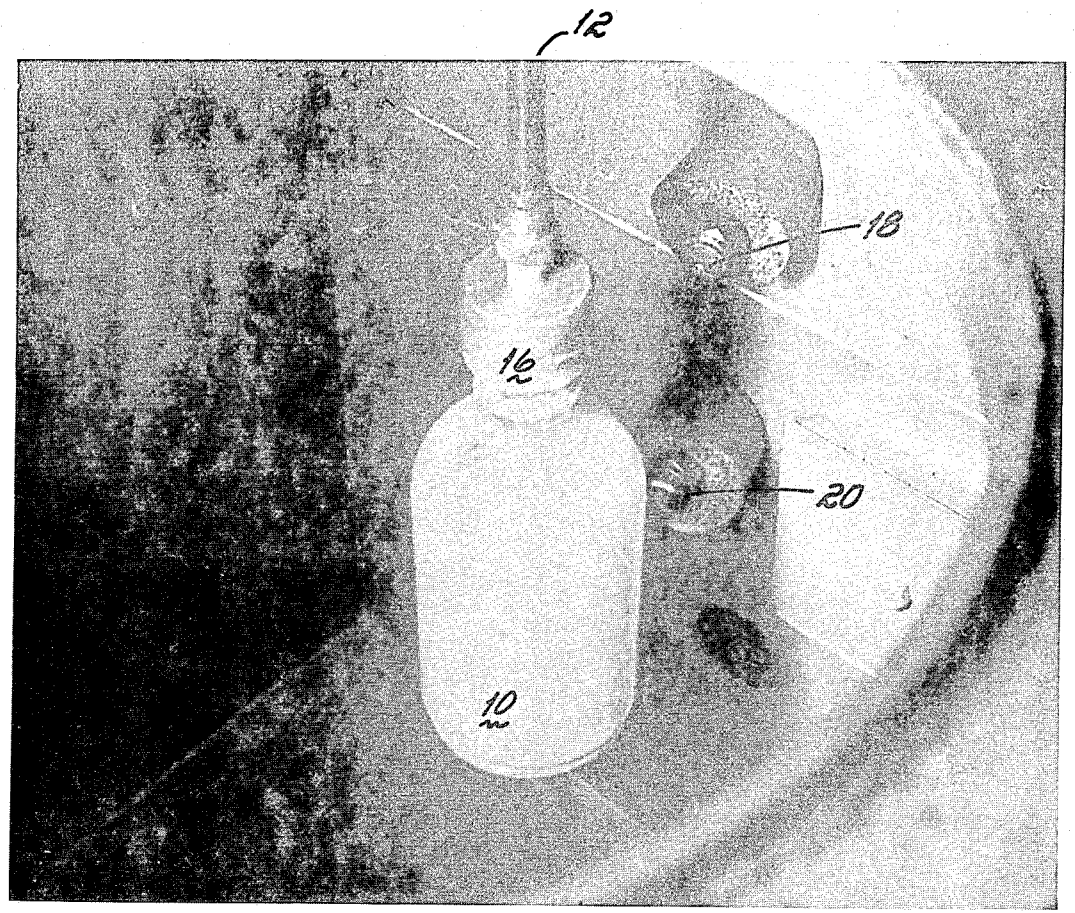
FIG. 2 is a photograph similar to FIG. 1 showing the PET bottle 15 seconds after coating and before drying of the coating.
Figure 5:
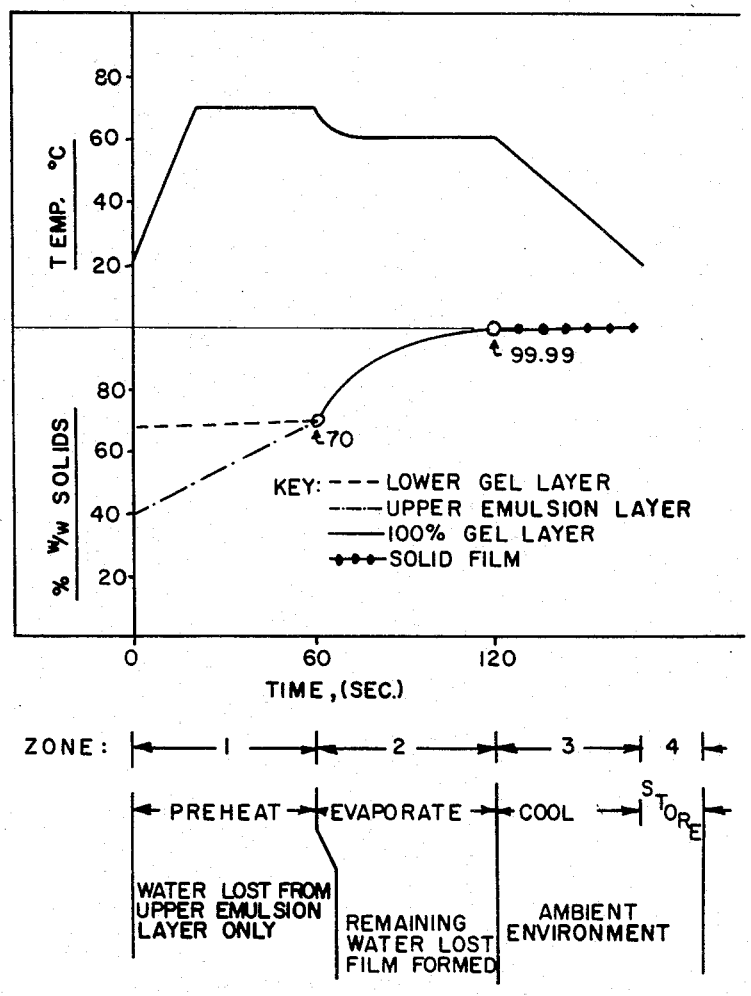
FIG. 5 is a graph illustrating the drying process for the impact gel/emulsion-two layer wet coating of this invention.

FIG. 2 shows the bottle 15 seconds after coating and before drying of the coating. At this stage the bottle has a wet layer of emulsion substantially uniformly coated on it. This layer is normally about 4 to 24 microns thick. It has been determined that the structure of this layer is critical to the conduct of this invention. This structure consists of a thin gel film of the polymer at the interface of the coating and the bottle and this gel film is characterized by a substantially continuous film of polymer which no longer exists as discrete particles. As the structure of the emulsion layer is developed outwardly from the surface of the bottle, the gel layer is transformed into an upper layer of emulsified or dispersed polymeric particles. It has been determined that the thin gel layer performs at least two essential functions. The gel layer at the interface of the bottle enables the coating film to adhere to the surface of the bottle substrate and it establishes a foundation upon which a barrier coating having the substantially superior properties of this invention may be produced. Upon controlled drying, preferably radiant heating, the gelation of the upper layer is completed whereby the polymeric film foundation which has been established at the interface is built upon until the entire uppermost part of the coating is in a gel state of the same nature as the underlying interfacial layer. The exact mechanism whereby the entire coating is converted into a gel is not completely understood but it occurs upon quickly drying the coating. However, it has been established that the gel layer is essential in order for the coating to adhere to the surface of the bottle without run-off or detrimental sagging to enable the complete gelation to be effected as water is continuously removed from the wet layer of the coating. At the end of the drying cycle when nearly all of the water is lost from the gel state of the coating, coalescence of the polymeric particles and coating composition into a film is achieved. FIG. 5 is a graph of the drying process for the impact gel/emulsion two-layer wet coating of the invention.

Figure 3:
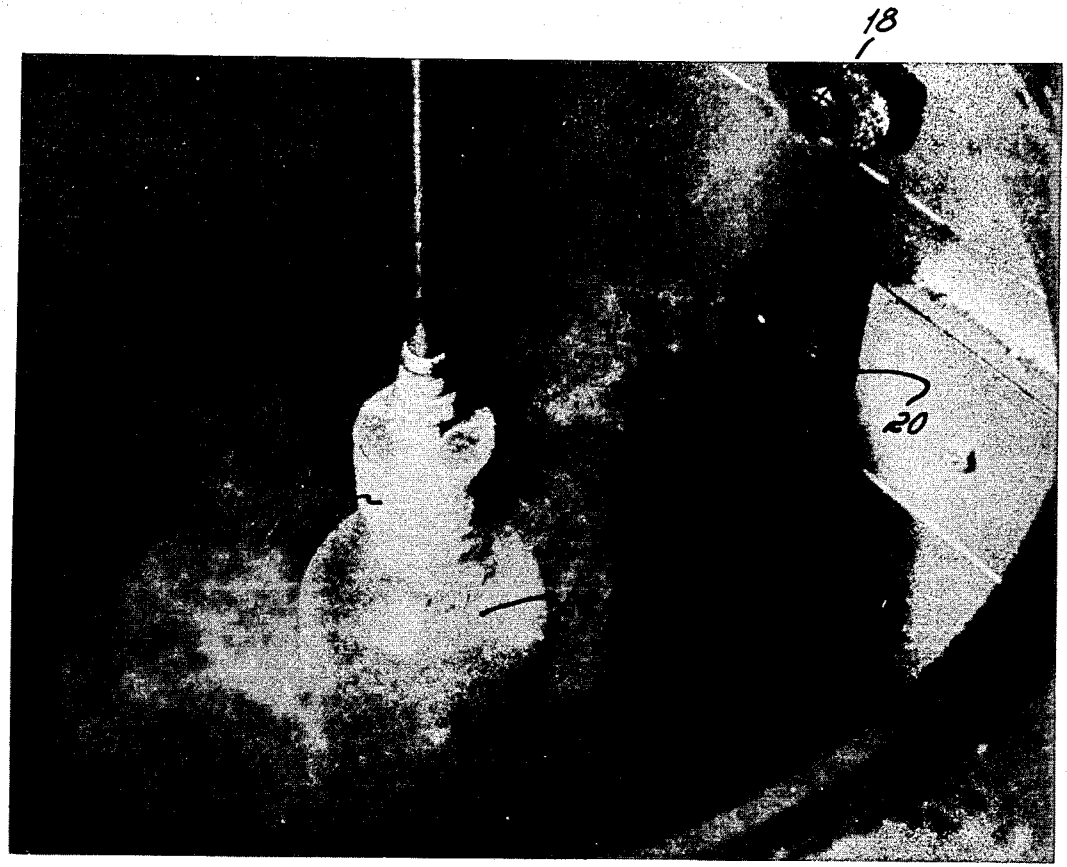
FIG. 3 is another photograph of the same experimental apparatus shown in FIGS. 1 and 2 but showing coating of a PET bottle with the bottle spaced from the spray nozzle.

FIG. 3 shows a second bottle 22 located 4½ inches from the nozzles 18 and 20 during the coating operation, all other conditions being the same. Comparing FIG. 1 to FIG. 3, the impact of the stream of emulsion material on the surface of the bottle 10 in FIG. 1 was significant compared to that shown in FIG. 3. That is, in FIG. 1, the stream of aqueous dispersion emanating from the spray nozzles could be characterized as a vigorous "scrubbing" or "washing" of the surface of the bottle 10, while in the arrangement shown in FIG. 3, the bottle surface was exposed to what was closer to a soft mist. In other words, spraying of emulsion latices or dispersions as suggested in the prior art techniques which leads to an atomization of the aqueous dispersion is represented by FIG. 3 and such is completely unsatisfactory in order to achieve the advantages of this invention. It has been found that it is essential that a stream of the aqueous dispersion be directed at the substrate and impact thereon, with significant force so that the emulsion coating is destabilized at the interface with the bottle so as to form gel film solids of the emulsion at the interface as pointed out above. Spraying as that term is understood by a person of ordinary skill conveys the connotation of atomization. Atomization or coating in its traditional context does not provide the sufficient impact force within which the essential interfacial gel layer is achieved. While the airless spray nozzles have been employed to achieve the results of this invention as described hereinabove along with the photographic figures of this application, it has been demonstrated empirically by following the description of the operating examples that atomization or spraying in the classical sense of the prior art as demonstrated by FIG. 3 does not produce the significant impact in order to create the essential interfacial gel layer which initiates destabilization of the emulsion which may then importantly serve as a foundation for the complete gelation of the entire coating upon controlled drying which will in turn lead to ultimate complete coalescence of the polymeric film solids.

With reference to FIG. 1 and particular attention to the stream of polymeric emulsion as it immediately exits from the airless spray nozzle, the stream is essentially continuous for a short distance as it exits from the nozzle and may be characterized as a sheet of liquid perhaps on the order of about 0.5 to about 1 inch in length. There is no break-up as the sheet of liquid initially exits from the nozzle, but thereafter for a distance of up to about 1.5–2 inches break-up occurs. As break-up occurs, the sheet of liquid is destroyed into fibrils or filaments which in turn, as the stream projects farther from the nozzle, are further atomized into drops. It has been found that the results of this invention can be achieved employing the nozzle of Example 1 under similar conditions as low as a distance of approximately 1 inch between the nozzle and the bottle substrate. At this distance of approximately 1 inch under the conditions, the stream of liquid is just starting to break up, and over the next 1½ inches or up to the distance of about 2½ inches as demonstrated in FIG. 1, the stream is mostly comprised of fibrils or filaments and not atomized particles. At this distance of about 2½ inches, the preferred operation of this invention is achieved. As the substrate is further spaced apart as developed above and represented by FIG. 3, the particles become atomized and they do not impact on the target, nor is the hydraulic scrubbing or washing of the bottle surface effected so as to achieve the interfacial gel film which is essential to the principles of this invention. Applicants do not wish to be limited to, nor do the operating principles of this invention require, any particular point at which the stream emanating from the nozzle is either in a continuous liquid, fibril or dispersed particle state. The significant point is that the impact of the stream on the surface achieves the interfacial gel layer critical to achieving the advantages of this invention. Whereas spraying of emulsion according to prior art techniques may have been suggested, it is submitted that spraying to achieve an atomized state, applicants have demonstrated, does not provide the necessary impacting or hydraulic scrubbing of the surface with the emulsion to initiate destabilization of the emulsion and provide the gel film of polymeric coating at the interface of the bottle. Wherefore applicants believe they have discovered a new method of applying a barrier coating by impacting a stream of aqueous polymeric dispersion on the bottle surface.

FIGS. 1–3 visually demonstrate the differing effect of locating the bottle to be coated in close proximity to the nozzle such that the surface is actually impacted with the airless spray stream as opposed to locating it a distance away where, although the spray contacts the bottle surface, there is insufficient impacting force or shear to initiate uniform coalescence of the polymer coating. The terms "initiate uniform coalescence" are intended to convey in this description the formation of the gel film at the interface of the bottle upon impact with the aqueous polymeric dispersion. In other words, they are inherently describing the same phenomenon that has occurred as a result of following the procedures of Example 1 and as illustrated in photographic FIG. 1.

The results of various test runs comparing the surface appearance of ½ liter bottles coated at different distances are set forth in the Table below. In each case the coating was dried to a tack-free or dry to the touch state by radiant heating by continuing rotation of the bottle over a hot plate. The hot plate was heated to a surface temperature of about 600° F. under ambient humidity of the room and the bottles were held about 3.5" to 4" above the plate surface with rotation on their sides at about 10 to 60 rpm. Thermocouples centered 3 and 4 inches above the plate surface yield 158° F. and 149° F., respectively.

TABLE

| Sample | Nozzle Pressure (psig) | Distance (Inches) | Time (Mscs.) | Bottle Weight (After and Before Coating | Net Coating Weight Per Bottle (mg) | *Appearance |
|---|---|---|---|---|---|---|
| A | 750 | 2½ | 200 | 24.52<br>24.03 | 490 | 10 |
| B | 650 | 2½ | 200 | 24.53<br>24.08 | 450 | 10 |
| C | 350 | 2½ | 200 | 24.31<br>23.91 | 400 | 9 |
| D | 750 | 4½ | 200 | 24.41<br>23.97 | 440 | 8 |
| E | 650 | 4½ | 200 | 24.33<br>23.95 | 380 | 5 |
| F | 350 | 4½ | 200 | 24.42<br>24.08 | 340 | 5 |
| G | 750 | 6½ | 200 | 24.47<br>24.07 | 400 | 5 |
| H | 550 | 6½ | 200 | 24.33<br>24.00 | 350 | 4 |
| I | 350 | 6½ | 200 | 24.29 | 280 | 1 |

TABLE-continued

| Sample | Nozzle Pressure (psig) | Distance (Inches) | Time (Mscs.) | Bottle Weight (After and Before Coating | Net Coating Weight Per Bottle (mg) | *Appearance |
|---|---|---|---|---|---|---|
| | | | | 24.01 | | |

*Degree of continuous film
0 (bad)-10 (good)
Noncontinuous-continuous

Referring to Table I, it may be seen that test samples A and B which were located in relatively close proximity to the spray nozzles, i.e., at about 2½ inches, had excellent, uniformly transparent PVDC coatings which were superior in appearance and uniformity. Sample C, also located at 2½ inches from the nozzle had a slightly poorer appearance which is attributable to the substantially lower nozzle pressure and thus lower impacting force of the spray or stream as compared to Samples A and B. All had good coating weights. For a ½ liter bottle, the area to be coated is about 55 square inches. The density of the PVDC material was about 1.6. Uniformly applied, a 400 mg coating thus translates to a thickness of about 8 microns which is within the scope of the present invention.

When the bottles were moved away from the nozzles as in Samples D-I the coating quality became progressively worse.

For example, comparing Sample A with Sample G, the nozzle pressures and exposure times were the same, but Sample A which was located 2½ inches from the nozzle had a superior coating while Sample G located 6½ inches from the nozzles was unacceptable. It should be recognized that any appearance below a 9 is not commercially acceptable. Thus, Sample D, which was located 4½ inches from the nozzle (a location illustrated by FIG. 3) was commercially unacceptable even though coated at the same nozzle pressure and exposure time as Sample A and having relatively good coating weight.

In summary, the foregoing Table shows that sample bottles located 2½ inches from the nozzles operating at pressures from 350 to 750 psig showed excellent to superior results. Sample bottles displaced from the nozzles 4½ to 6 ½ inches had vastly inferior coatings which would be commercially unacceptable in terms of coating quality.

Figure 4:
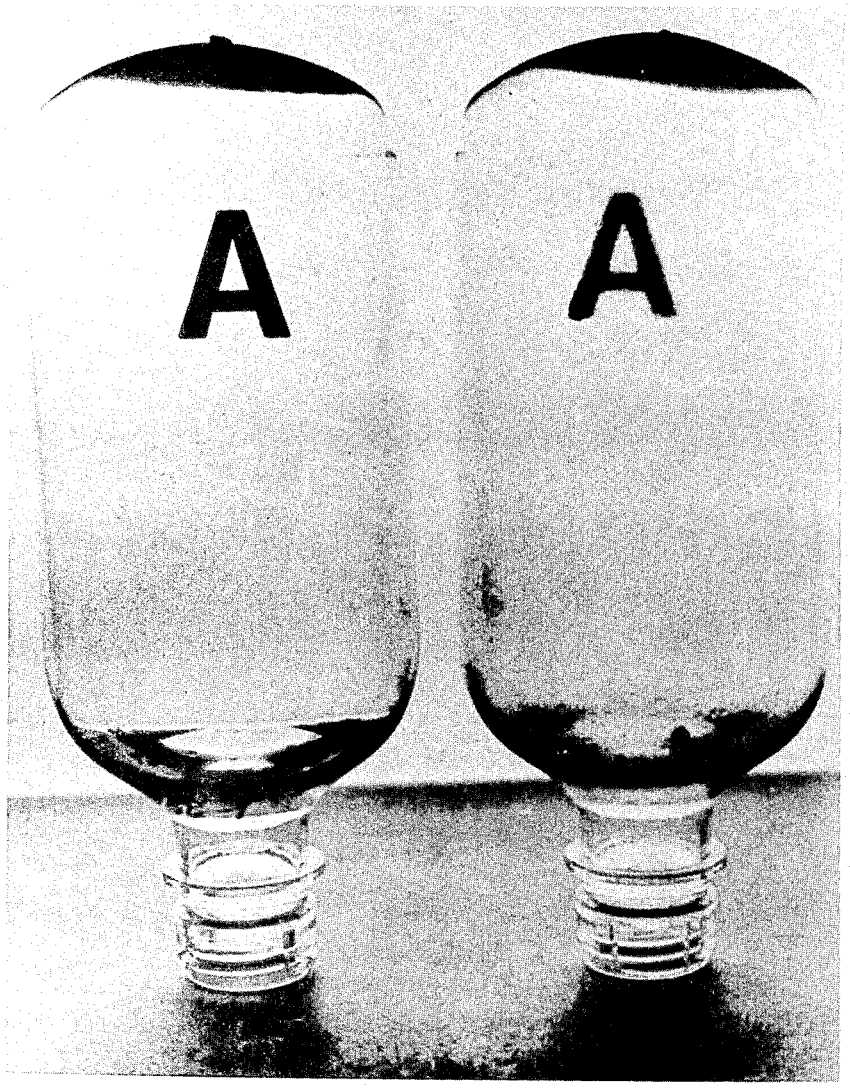
FIG. 4 is a photograph comparing the appearance of bottles coated according to the methods shown in FIGS. 1 and 2 and that shown in FIG. 3.

In explanation of these results, it is believed that when the bottle is located in close proximity to the airless spray stream nozzle that the force of the airless spray of material impacting on the bottle surface is greatest. It is believed that this force creates a shear on the polymer coating material as it impacts the surface of the bottle which is believed to be critical to the initiation of uniform coalescence of the polymer particles which in turn is critical to achieving a uniform polymer coating. The action of the spray on the bottle can be variously described as "hydraulic scrubbing" or a "shearing" action; but, nevertheless, the impacting of the coating on the surface of the bottle has been found critical to achieving the results achieved by the present invention. Inherently in the practice of the process as indicated above, a gel layer or film is formed at the interface of the coating and the bottle as a result of the impacting of the stream of emulsion on the bottle surface. A person of ordinary skill in this art, therefore, following the specific examples in this invention would be able to ascertain the necessary parameters in order to practice its principles. Upon microscopic examination on the order of 500 to 1000 times, the gel film or layer of solids coating material is ascertainable. This enables the emulsion to stick or adhere to the bottle substrate and serve as the foundation for the complete gelation of the film followed by complete coalescence to achieve the uniformity and transparency required for excellent barrier properties The importance of coating quality can be appreciated by referring to FIG. 4 wherein two ½ liter bottles are compared side-by-side. The bottle on the left was coated at a distance of 2½ inches from the nozzle while the bottle on the right was located at a distance of 4½ inches. The letter "A" is located behind each bottle such that the viewer must look through the bottle to see the letter. As is clearly apparent, the bottle on the left has a highly uniformly transparent coating while that on the right has a coating which is mottled and non-uniform and one that is commercially unacceptable.

As stated above, it will be appreciated that the range of distances at which the bottle can be placed is a function of nozzle size, the pressure of the spray stream, the coating time and rotational speed of the bottle. However, it has been found critical that the relation of these variables to the distance the bottles are spaced away from the spray nozzle be such that the force of the stream of emulsion on the bottles is sufficient to initiate uniform coalescence of the polymer coating material. For instance, the revolution of the bottle may range from 500 up to 1500 rpm. As the gel has completely formed on the bottle by effecting a build up of coating weight under conditions exemplified by the above Examples, the coating has been found to be limiting, i.e., streaming of the dispersion around the bottle occurs. This demonstrates that the gel layer is functioning to cushion against the further formation of gel and that there is a layer of stabilized dispersion on the gel layer. Further impacting the stream substantially perpendicularly, rather than tangentially, to the arcuate bottle surface provides the results.

EXAMPLE II

To further illustrate the principles of this invention, a latex of vinylidene chloride/lower alkyl acrylate and acrylonitrile (Union M3-153) was impact coated employing the apparatus above described in connection with FIG. 1. The latex had a specific gravity of 1.190 and about 40% solids. The main chemical polymeric content of the copolymer was qualitatively confirmed by infrared spectra, and the monomer percents are like the typical amounts listed. Using the airless nozzle apparatus described in connection with FIG. 1 example, 12 PET bottles were sprayed at a proximity of about 2½" between the nozzle arrangement and the bottles. The spray occurred substantially perpendicularly to the arcuate surface of the bottles at a nozzle pressure of about 650 psig, 200 millisecond exposure and 600 rpm rotation speed. It is necessary in order to coat the bottle employing the impact process to provide two complete revolutions of the bottle. Under the conditions of this example, the 600 rpm was equal to:

$$\frac{2 \text{ revolutions}}{200 \text{ milliseconds}} \times \frac{1000 \text{ milliseconds}}{1 \text{ second}} \times \frac{60 \text{ seconds}}{1 \text{ minute}}$$

Coating weights of between about 400 and 470 were achieved for the 12 bottles. A 400 milligram coating translates to a thickness of about 8 microns, as indicated above. After coating the bottle, the wet coating was dried over a radiant hot plate having a surface temperature of about 600° F. for about 1½ minutes where the bottle was rotated in a horizontal plane about its horizontal axis a distance of about 3½ inches above the hot plate at a rate of between 10 and 60 rpms. Thermocouples centered 3 and 4 inches above the plate surface yield 158° F. and 149° F., respectively. Bottles coated under these conditions had a rating of 10 which qualitatively meant they would be commercially acceptable as providing a uniformly transparent coating having the characteristics and excellent quality as represented by the acceptable bottle in photographic FIG. 4. The coating process was conducted in such a manner that a thin gel film of the polymer was produced at the interface of the coating with the bottle. As the structure of the gel layer is developed outwardly from the surface of the bottle, it is surmounted by an upper layer of dispersed polymeric particles. The appearance of the wet bottle at this stage is essentially the same as that shown in FIG. 2 approximately 15 seconds after coating and before drying of the coating. The thin gel layer performed the essential functions of uniform adhesion of the dispersion in the wet state of the coating and, upon controlled drying with radiant heat, the uniformly transparent barrier coating was obtained. The polyethylene terephthalate bottle was obtained having a smooth, uniform, uniformly transparent, substantially crack and craze-free polymer coating on the outside surface thereof, said coating having a gas-impermeability such that a bottle having an internal pressurization of 60 psig loses 9 psig or less pressurization over a 16-week period at 23° C.

EXAMPLE III

Another group of bottles was processed according to the identical procedures of EXAMPLE II except that the drying of the wet film was conducted with oven convection heat for approximately 3 minutes at 160° F. at a relative humidity of 1%. Upon comparison of the bottles processed according to EXAMPLE II with those of EXAMPLE III, it was determined that the relatively short radiant heat technique as opposed to the convection heating provided the best shelf life. Accordingly, the radiant heating technique is the preferred technique for completing the gelation of the wet film and collapsing it to a uniformly transparent barrier coating.

EXAMPLE IV

To further illustrate the principles of this invention, a latex of vinylidene chloride/lower alkyl acrylate and acrylonitrile (Morton Serfene 2011) was impact coated employing the apparatus above described in connection with FIG. 1. The latex had a specific gravity of 1.195 and about 40% solids. The main chemical polymeric content of the copolymer was qualitatively confirmed by infrared spectra, and the monomer percents are like the typical amounts listed at page 15. Using the airless nozzle apparatus described in connection with FIG. 1 example, 12 PET bottles were sprayed at a proximity of about 2½" between the nozzle arrangement and the bottles. The spray occurred substantially perpendicularly to the arcuate surface of the bottles at a nozzle pressure of about 650 psig, 200 millisecond exposure and 600 rpm rotation speed. Coating weights of between about 400 and 470 were achieved for the 12 bottles. A 400 milligram coating translates to a thickness of about 8 microns, as indicated above. After coating the bottle, the wet coating was dried over a radiant hot plate having a surface temperature of about 600° F. for about 1½ minutes where the bottle was rotated in a horizontal plane about its horizontal axis a distance of about 3½ inches above the hot plate at a rotational speed between 10 and 60 rpms. Thermocouples centered 3 and 4 inches above the plate surface yield 158° F. and 149° F., respectively. Bottles coated under these conditions had a rating of 10 which qualitatively meant they would be commercially acceptable as providing a uniformly transparent coating having the characteristics and excellent quality as represented by the acceptable bottles in photographic FIG. 4. The coating process was conducted in such a manner that a thin gel film of the polymer was produced at the interface of the coating with the bottle. As the structure of the gel layer is developed outwardly from the surface of the bottle, it is surmounted by an upper layer of the remaining dispersed polymeric particles. The appearance of the wet bottle at this stage is essentially the same as that shown in FIG. 2 approximately 15 seconds after coating and before drying of the coating. The thin gel layer performed the essential functions of adhesion of the dispersion in the wet state of the coating and, upon controlled drying with radiant heat, the uniformly transparent barrier coating was obtained. The polyethylene terephthalate bottle was obtained as set forth in EXAMPLE II.

EXAMPLE V

Another group of bottles were processed according to the identical procedures of EXAMPLE IV except that the drying of the wet film was conducted with oven convection heat for approximately 3 minutes at 130°–155° F. at a relative humidity of 1%. Upon comparison of the bottles processed according to EXAMPLE III with those of EXAMPLE IV, it was determined that the relatively short radiant heat technique as opposed to the convection heating provided the best shelf life. Accordingly, the radiant heating technique is the preferred technique for completing the gelation of the wet film and collapsing it to a uniformly transparent barrier coating.

Variations from the specific embodiments of the invention disclosed will be apparent to a person of ordinary skill in this art and the above examples are therefore not considered to limit the scope of the invention.

We claim:

1. A process for coating a substrate with a uniform polymeric coating comprising providing a substrate having a surface to be coated, impacting said surface with a stream of a stabilized dispersion of polymer in water, initially forming on said surface a gel coating layer bonded to said surface and caused by destabilization of said dispersion upon said impact, thereafter continuing to expose the gelled coating layer to said stream of stabilized polymer dispersion to produce a wet integral coating including a covering layer of polymer dispersion completely covering said gel layer, said gel layer serving as an interfacial layer to adhere said covering layer of polymer dispersion to said substrate, heating said wet integral coating to form a substantially completely gelled coating throughout its thickness on said surface, and further heating said gelled coating to coalesce said polymer into a substantially uniform coating on said substrate.

2. The process of claim 1 wherein said substrate is a preformed plastic.

3. The process of claim 2 wherein said preformed plastic is polyethylene terephthalate and the polymer of said stabilized dispersion is a copolymer of vinylidene chloride.

4. The process of claim 3 wherein said copolymer contains other copolymerized monomers selected from the group consisting of a lower alkyl acrylate, acrylonitrile and acrylic acid, and mixtures thereof.

5. The process of claim 1 wherein said substrate is a preformed plastic container.

6. The process of claim 5 wherein said preformed plastic container is made of polyethylene terephthalate and the polymer of said stabilized dispersion is a copolymer of vinylidene chloride.

7. The process of claim 5 wherein said plastic container is a bottle having an arcuate exterior surface and said stream is impacted with said surface at an angle substantially perpendicular thereto.

8. The process of claim 7 wherein said bottle is rotated during the impacting and formation of said wet integral coating.

9. The process of claim 1 wherein said heating to form the substantially completely gelled coating is conducted by radiant heating means.

10. The process of claim 9 wherein said wet integral coating is deposited at a thickness in the range of about 4 to about 24 microns.

11. The process of claim 10 wherein said wet integral coating is subjected to drying for a period of time from about 1 to about 2 minutes.

12. The process of claim 9 wherein said substrate is a bottle which is rotated about its horizontal axis while it is exposed to said radiant heating means.

13. The process of claim 1 wherein said stream is impacted on said surface by means of an airless spray nozzle.

14. The process of claim 13 wherein said airless spray nozzle directs said stream at an angle substantially perpendicular to said substrate surface.

15. The method of claim 13 wherein said substrate is a plastic bottle and said airless spray nozzle provides said stream of a copolymer of vinylidene chloride.

16. The process of claim 15 wherein said substrate is polyethylene terephthalate and said copolymer of vinylidene chloride contains at least one acrylic or methacrylic monomer.

17. The process of claim 16 wherein said copolymer consists essentially of 99 to 70% by weight of vinylidene chloride and 1 to 40% by weight of at least one acrylic or methacrylic monomer and further including up to 100 parts by weight of at least one member selected from other ethylenically unsaturated monomers per 100 parts by weight of the total amount of the first two monomers.

18. The process of claim 1 wherein the integral coating is applied to a thickness in the range of about 4 to 24 microns.

19. The process of claim 1 wherein the heating is controlled by hot air drying the coating in an atmosphere of 20–90% relative humidity.

20. A process for coating a substrate with a uniform polymeric coating comprising providing a polyethylene terephthalate container having an arcuate surface to be coated, impacting said surface with a stream of a stabilized dispersion of copolymer vinylidene chloride, initially forming on said surface a gel of said polymer coating layer bonded to said surface and caused by destabilization of said dispersion upon said impact, thereafter continuing to expose the gelled polymer coating layer to said stream of stabilized polymer dispersion to produce a wet integral coating including a covering layer of polymer dispersion completely covering said gel layer, said gel layer serving as an interfacial layer to adhere said covering layer of polymer dispersion to said substrate, heating said wet integral coating to form a substantially completely gelled coating throughout its thickness on said surface, and further heating said gelled coating to coalesce said polymer into a substantially uniform coating on said substrate.

21. The process of claim 20 wherein the coating is applied to a thickness in the range of about 2½ to 12 microns.

22. The process of claim 20 wherein said heating and further heating is conducted by radiant means.

23. The process of claim 20 wherein the containers are continuously rotated while being impacted with said stream produced from an airless spray nozzle.

24. The process of claim 23 wherein the containers are rotated and said stream impacts on said surface at an angle substantially perpendicular thereto.

25. A process for coating a substrate with a uniform polymeric coating comprising providing a bottle having an arcuate exterior surface to be coated, impacting said surface with a stream of a stabilized dispersion of copolymer vinylidene chloride at an angle substantially perpendicular thereto, initially forming on said surface a gel coating layer bonded to said surface and caused by destabilization of said dispersion upon said impact, thereafter continuing to expose the gelled coating layer to said stream of stabilized polymer dispersion to produce a wet integral coating including a covering layer of polymer dispersion completely covering said gel layer, said gel layer serving as an interfacial layer to adhere said covering layer of polymer dispersion to said substrate, heating by radiant heating means said wet integral coating to form a substantially completely gelled coating throughout its thickness on said surface, and further heating said gelled coating to coalesce said polymer into a substantially uniform coating on said substrate.

26. The process of claim 25 wherein a continuously moving line of bottles is provided at a rate of 300 bottles or more per minute.

27. The process of claim 25 wherein radiant heating is carried out during rotation of the bottle on its side.

28. The process of claim 25 wherein the bottle is continuously rotated while being impacted with said stream and while being heated.

* * * * *